US006450713B2

(12) United States Patent
Parthasarathy et al.

(10) Patent No.: US 6,450,713 B2
(45) **Date of Patent: *Sep. 17, 2002**

(54) PRINT MEDIA EJECTION SYSTEM

(75) Inventors: Baskar Parthasarathy, Singapore (SG); Sathiyamoorthy T. Sivanandam, Singapore (SG); Kong Hock Lim, Singapore (SG); Wei Ming Pan, Singapore (SG)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/454,891

(22) Filed: Dec. 3, 1999

Related U.S. Application Data

(63) Continuation-in-part of application No. 09/394,178, filed on Sep. 10, 1999, now abandoned.

(51) Int. Cl.[7] ..... B41J 13/02

(52) U.S. Cl. ..... 400/641; 271/269

(58) Field of Search ..... 400/641, 638, 400/639.1, 602, 600.2, 636; 347/104; 271/269, 271, 177

(56) References Cited

U.S. PATENT DOCUMENTS

| | | | | | |
|---|---|---|---|---|---|
| 4,488,830 | A | * | 12/1984 | Runzi | 400/636 |
| 5,560,726 | A | * | 10/1996 | Kawaguchi | 400/641 |
| 5,636,929 | A | * | 6/1997 | Asano et al. | 400/641 |
| 5,738,454 | A | * | 4/1998 | Zepeda et al. | 400/625 |
| 5,749,569 | A | * | 5/1998 | Atsumi et al. | 271/10.11 |
| 5,890,821 | A | | 4/1999 | Lesniak | 400/625 |
| 5,971,638 | A | * | 10/1999 | Sato et al. | 400/578 |

* cited by examiner

*Primary Examiner*—John S. Hilten
*Assistant Examiner*—Darius N. Cone

(57) ABSTRACT

An output roller for propelling a media sheet, for example in a printer, is disclosed. A plurality of protrusions is selectively positioned on the output roller. As the media sheet exists a media path, the rear edge of the media sheet is caught by the protrusions and the rear edge is further pushed forward into an output stack. Preferably, the protrusions are flexible.

23 Claims, 8 Drawing Sheets

PRINT MEDIA EJECTION SYSTEM

This is a continuation-in-part of application also entitled "PRINT MEDIA EJECTION SYSTEM", Ser. No. 09/394,178, now abandoned, filed Sep. 10, 1999 by Baskar Parthasarathy et al., and assigned to the present assignee.

BACKGROUND OF THE INVENTION

This invention relates generally to printers, and more particularly to media ejection systems for stacking media sheets in an output region or output tray.

Print jobs commonly include multiple media sheets fed along a media handling system through a print zone into an output tray or output region. Media sheets are fed in series with one sheet along the media path at a time for some printers or with multiple sheets along the media path at a time for other printers. Media sheets are stacked in the output tray. Many printers, especially ink jet printers, use a star wheel drive and an output roller to propel media sheets as the media sheets exit the media path. Ejected by the star wheel, the media sheet glides down the output roller by its own gravity and the momentum it gained during the ejection. In the conventional ejection mechanism of star wheel drive and output roller, however, the maximum momentum gained by the media sheet during the ejection is limited by the print swath width. And the ink contents make the media sheet sag and touch the previously printed media. This action resists the movement of the sheet. As a result, the media sheet has a tendency to cling to the surface of the output roller nearer to the star wheel interface, especially if the surface is rubber. Therefore, when it comes, the next media sheet hits the one clinging to the output roller. "Bull dozing" effect takes place and output stack gets disturbed.

U.S. Pat. No. 5,890,821, issued Apr. 6, 1999 for "Print Media Ejection Kicking after Paper Drop" assigned to Hewlett-Packard Company, discloses movable pivot devices used during ejection. The ejection system includes a movable pivot which supports the media sheet within the printing zone during printing. Upon completion of the printing, the pivot moves downward allowing the current media sheet to slide from the pivot into the output tray. This patent also introduces a kicker device coupled to the output tray to drive any remaining portion of the media sheet into the output tray. Nevertheless, coordinating the movement of the kicker device and pivot adds complexity to the ejection design.

SUMMARY OF THE INVENTION

In a preferred embodiment, the present invention provides a simplified structured print media ejection system that actively pushes a media sheet forward.

An embodiment of a print media ejection system according to the invention includes an output roller. A plurality of protrusions is selectively positioned on the roller. As the media sheet exits the media path, the rear edge of the media sheet is caught and further pushed forward into an output stack by the protrusions. The roller thus enhances the momentum of the ejected media sheet by propelling its rear edge and consequently reduces the possibility of "bull dozing".

Besides, the output roller also includes at least one longitudinal section without said protrusions.

Preferably, to catch the rear edge of the media sheet, the distance between the end edge of the protrusions and the axis of the roller is slightly longer than the radius of non-protrusion parts of the roller. Nevertheless, the preceding distance is limited so that the protrusions will not disturb the movement of the media sheet.

It is also preferred that the protrusions are located at certain parts of the roller, e.g., the middle part and/or the end part.

According to one aspect of the invention, the protrusions are flexible. Preferably, they are made of flexible materials, such as molded rubber. Besides, the protrusions are biased in a direction for the media sheet to be pushed. It is also preferred that the protrusions extend radially slightly above the non-protrusion parts of the output roller.

DETAILED DESCRIPTION OF THE PREFERRED EMBODIMENTS

Figure 1:
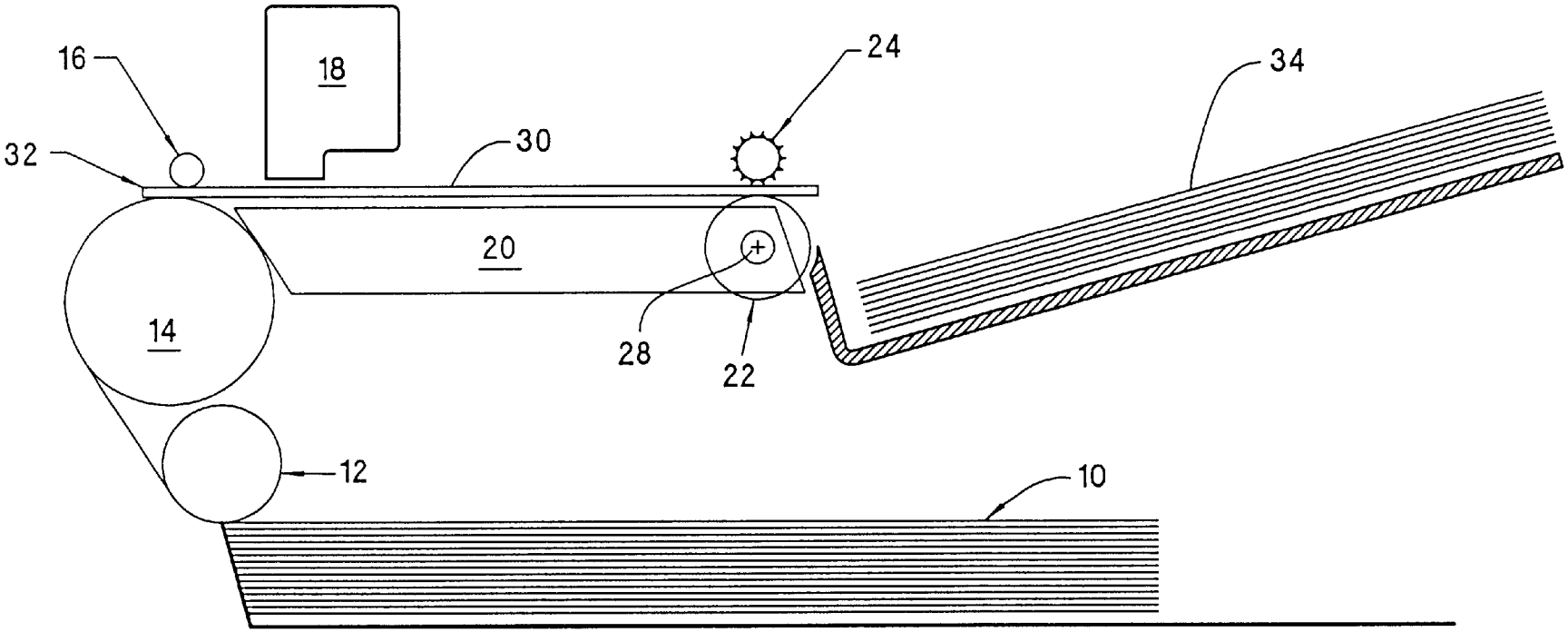
FIG. 1 shows sectionally the embodiment of the inkjet printer with a media sheet in the ejection cycle of printing.

As shown in FIG. 1, an exemplary inkjet printer, to which the present invention applies, includes a pick roller 12 employed to advance a media sheet 30 from an input stack 10 into engagement between a drive roller 14 and an outpinch roller 16. The media sheet 30 is then advanced by the outpinch roller 16 and drive roller 14 above a platen 20 employed to support the media sheet 30 during printing, and reaches a printing zone under a printing head 18. As the media sheet 30 comes to the interface 26 of a star wheel 24 and an output roller 22, the star wheel 24 and output roller 22 work in conjunction with the outpinch roller 16 and drive roller 14 to further advance the media sheet 30 during printing. As the rear edge 32 of the media sheet 30 leaves the outpinch roller 16, the star wheel 24 and output roller 22 continue to pull the media sheet 30 forward and eject it into an output stack 34. Note that other driven devices may be used in place of the star wheel 24 provided that the media sheet 30 is pulled forward after leaving the outpinch roller 16.

Figure 2:
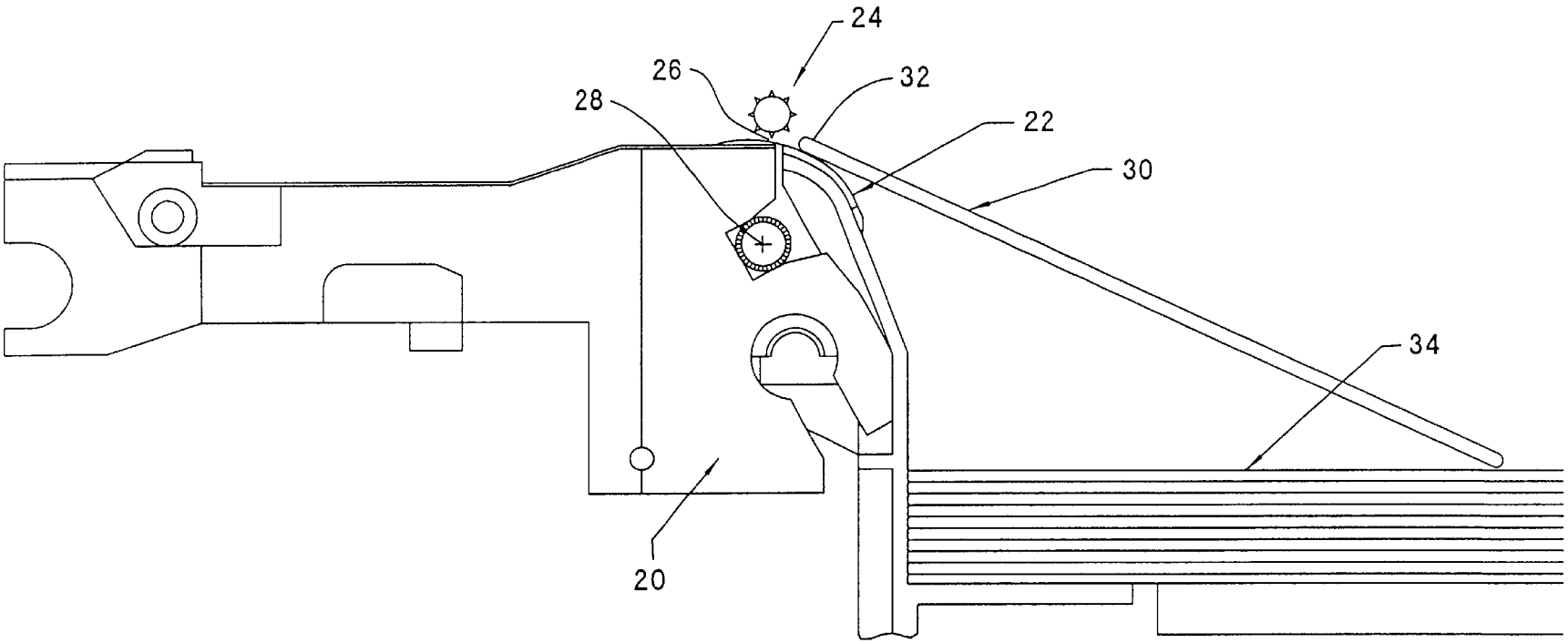
FIG. 2 shows the conventional print media ejection system wherein a media sheet clings to the surface of the output roller.

In FIG. 2, after the rear edge 32 of the media sheet 30 leaves the interface 26 of the star wheel 24 and output roller 22, the media sheet 30 glides down the output roller 22 by its own gravity and the momentum gained during the ejection. Owing to the limitation of the momentum and the resistance to its movement when the media sheet 30 sags and touches the previously printed media, the media sheet 30 has a tendency to cling to the surface of the output roller 22 nearer to the star wheel interface 26, especially if the surface is rubber. Thus, the next coming sheet hits the one clinging to the output roller 22. "Bull dozing" effect takes place and output stack gets disturbed.

Figure 3A:
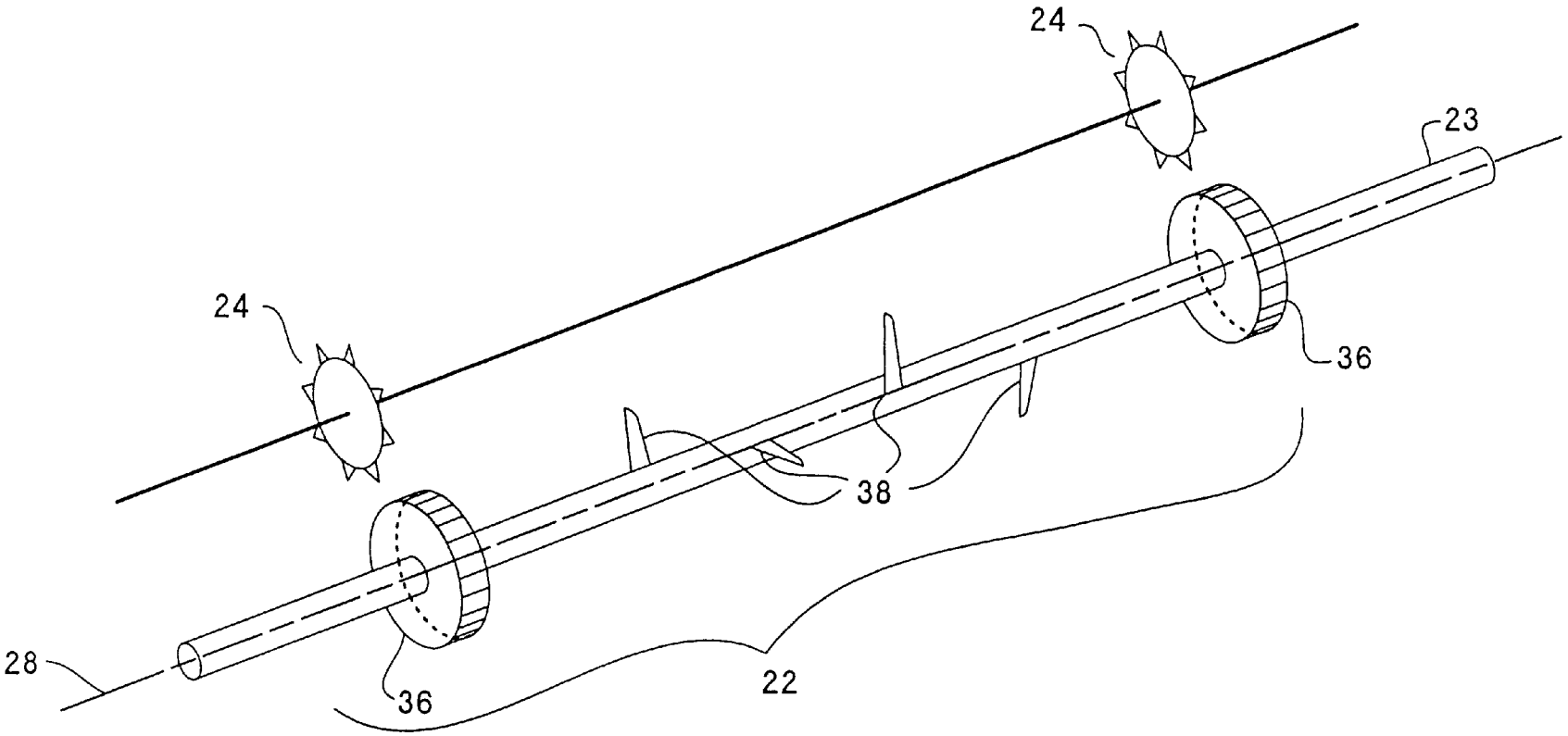
FIG. 3A shows a preferred embodiment of the output roller with a mating star wheel opposite to it.

FIG. 3A shows a preferred embodiment of the invention, wherein a plurality of protrusions 38 is selectively positioned on the output roller 22. The protrusions 38 catch the rear edge 32 of the media sheet 30 and then further push the media sheet 30 forward along with the rotation of the output roller 22. The output roller 22 also includes at least one longitudinal portion without protrusions, e.g., sections 36 in circular shape. The circular-shaped sections 36 work in conjunction with the mating star wheels 24 above to pull the media sheet 30 forward. The protrusions 38 are selectively positioned without star wheels 24 above contacting them so that the star wheels and protrusions will not interfere with each other. When other driven devices are used in place of the star wheel 24, the protrusions 38 may be positioned differently, depending upon the specific shape of the driven device. Moreover, the maximum distance between the end edge of the protrusions 38 and the axis 28 of the output roller 22 is only slightly, e.g., 0.37–0.50 millimeter, longer than the radius of the circular-shaped sections 36. In this manner, the protrusions 38 will not disturb the movement of the media sheet 30, while still be able to catch the rear edge 32 of the media sheet 30. Besides, the output roller 22 also has an output shaft 23, and it is preferred that the protrusions 38 are positioned on the output shaft 23 of the output roller 22.

Figure 3B:
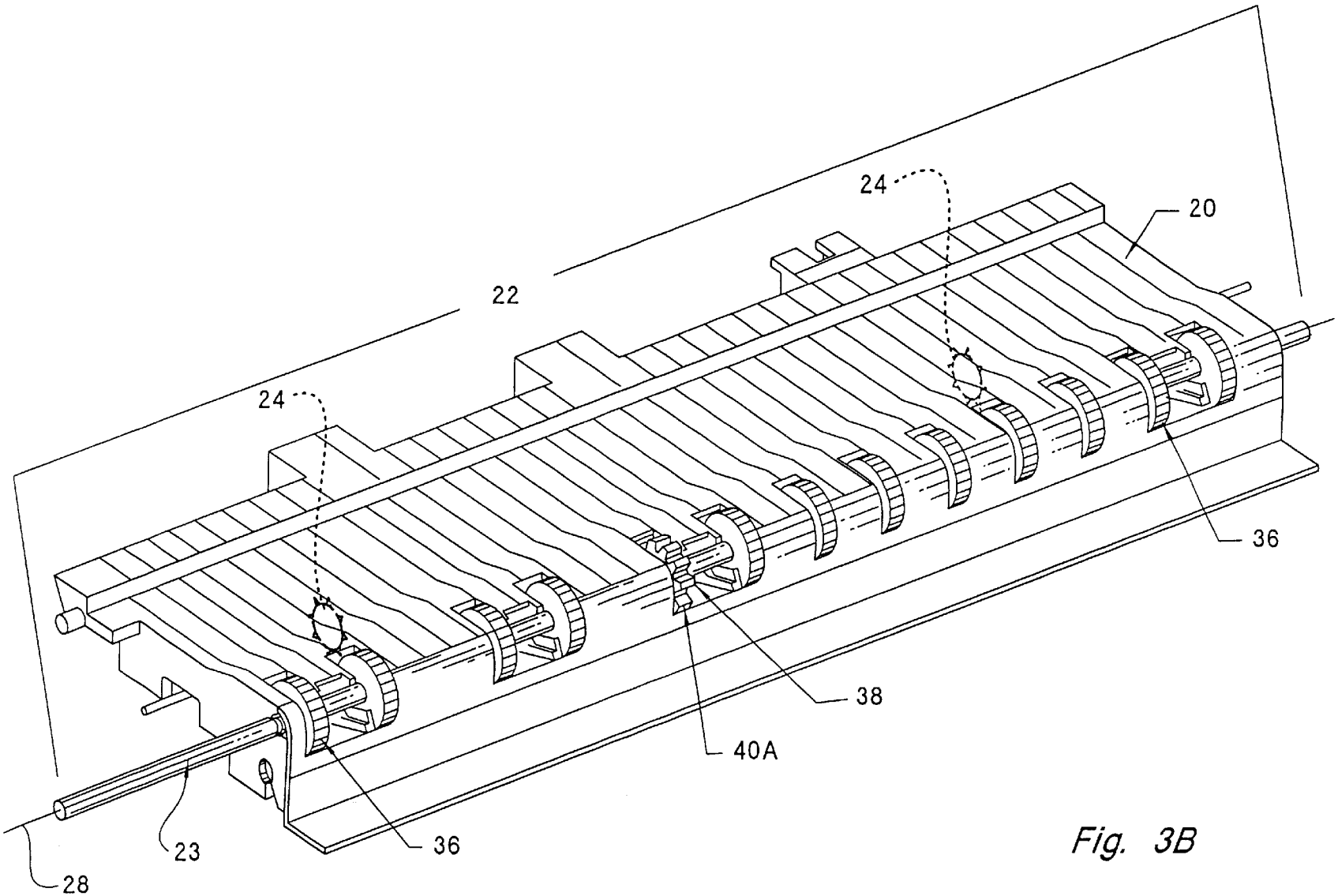
FIG. 3B shows another preferred embodiment of the output roller.

In a preferred mode shown in FIG. 3B, the protrusions 38 radiate from the output roller axis 28 and are located at certain part of the output roller 22 so that they form one tooth-shaped section 40A. The first tooth-shaped section 40A is located at the middle part of the output roller 22 without star wheels 24 above. When the rotative velocity of the output roller 22 is fixed, the maximum interval between adjacent protrusions 38 of the first tooth-shaped section 40A determines the maximum time period that the media sheet 30 clinging to the output roller 22 is caught by the protrusions 38. It is preferred that the protrusions 38 are evenly distributed among the first tooth-shaped section 40A. And the number of the protrusions 38 of the first tooth-shaped section 40A is preferred to be from 20 to 24. In addition, the diameter of the first tooth-shaped sections 40A is slightly, e.g., 0.75–1.00 millimeter, larger than the diameter of the circular-shaped sections 36.

Figure 4:
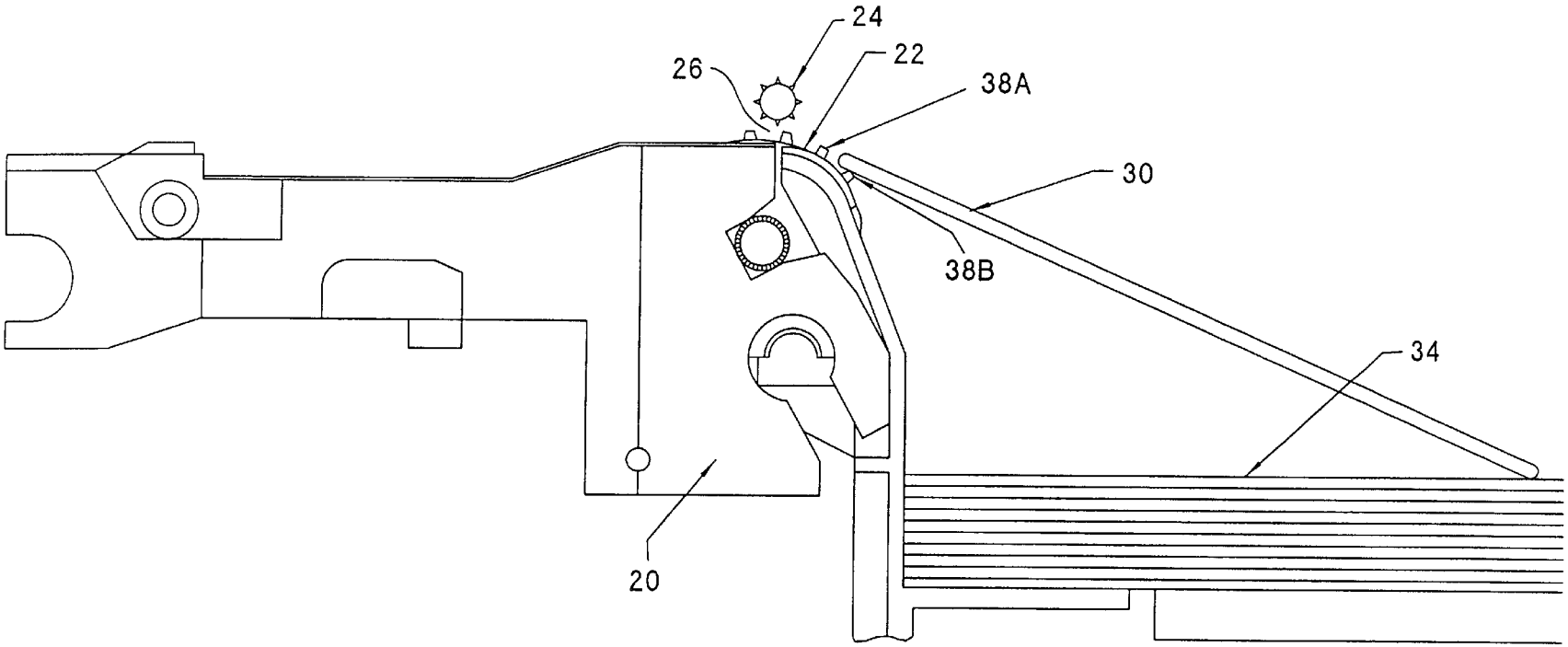
FIG. 4 shows sectionally the preferred print media ejection system wherein the output roller propels the rear edge of the media sheet.

In FIG. 4, when the rear edge 32 of the media sheet 30 leaves the interface 26 of the star wheel 24 and output roller 22, the rear edge 32 is caught in between two adjacent protrusions 38A and 38B. As the output roller 22 pivots, the back protrusion 38A pushes the rear edge 32 of the media sheet 30. Thus, the media sheet 30 is carried forward into the output stack 34.

Figure 3C:
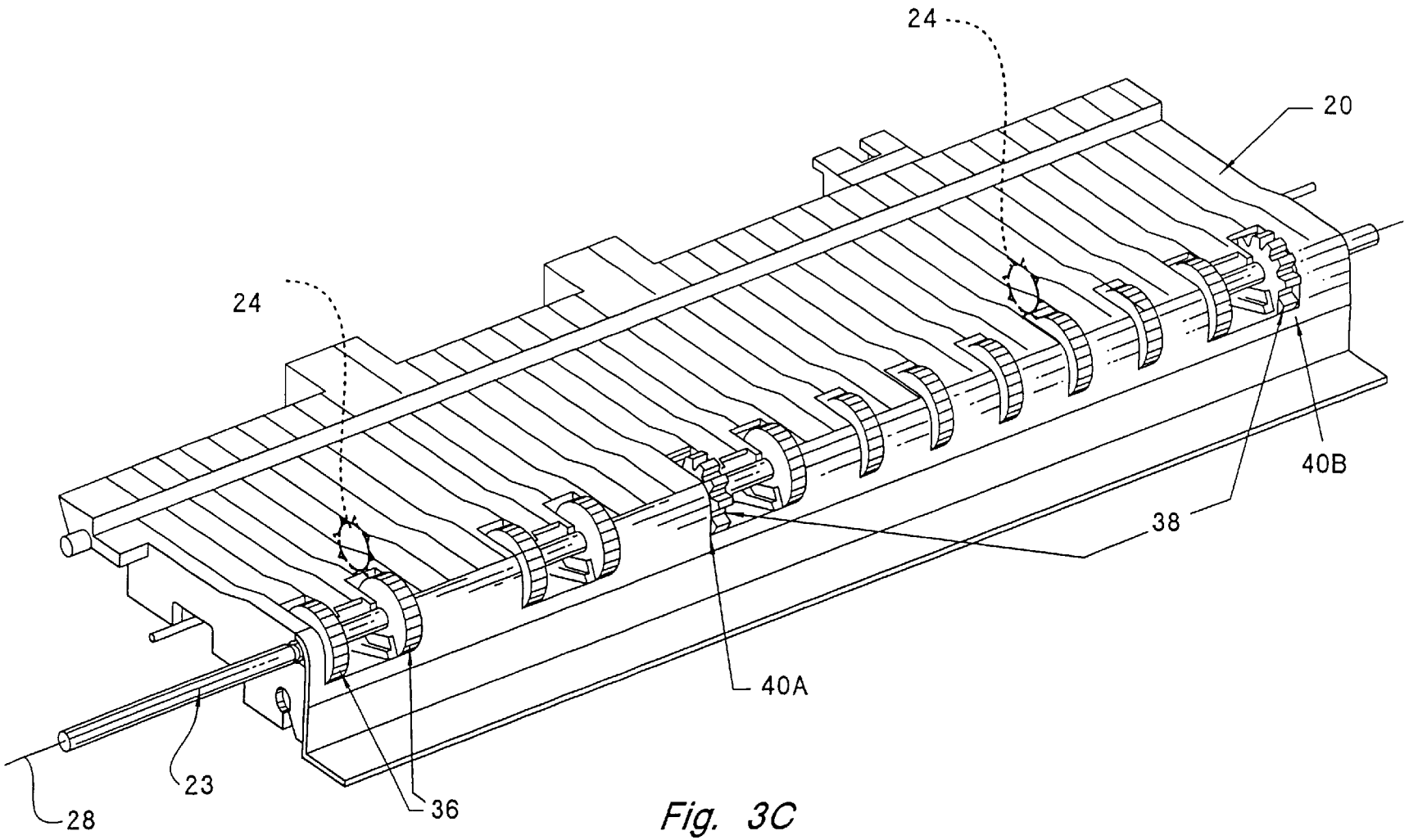
FIG. 3C shows the third preferred embodiment of the output roller.

In another preferred mode as shown in FIG. 3C, the protrusions 38 radiating from the output roller axis form another tooth-shaped section 40B, which is located at the end part of the output roller 22. The second tooth-shaped section 40B performs in the same way as the first tooth-shaped section 40A does, and is involved when the media sheet 30 is large. Moreover, the two tooth-shaped sections 40A and 40B are preferred to be similar in size and shape for convenience of manufacture.

Figure 3D:
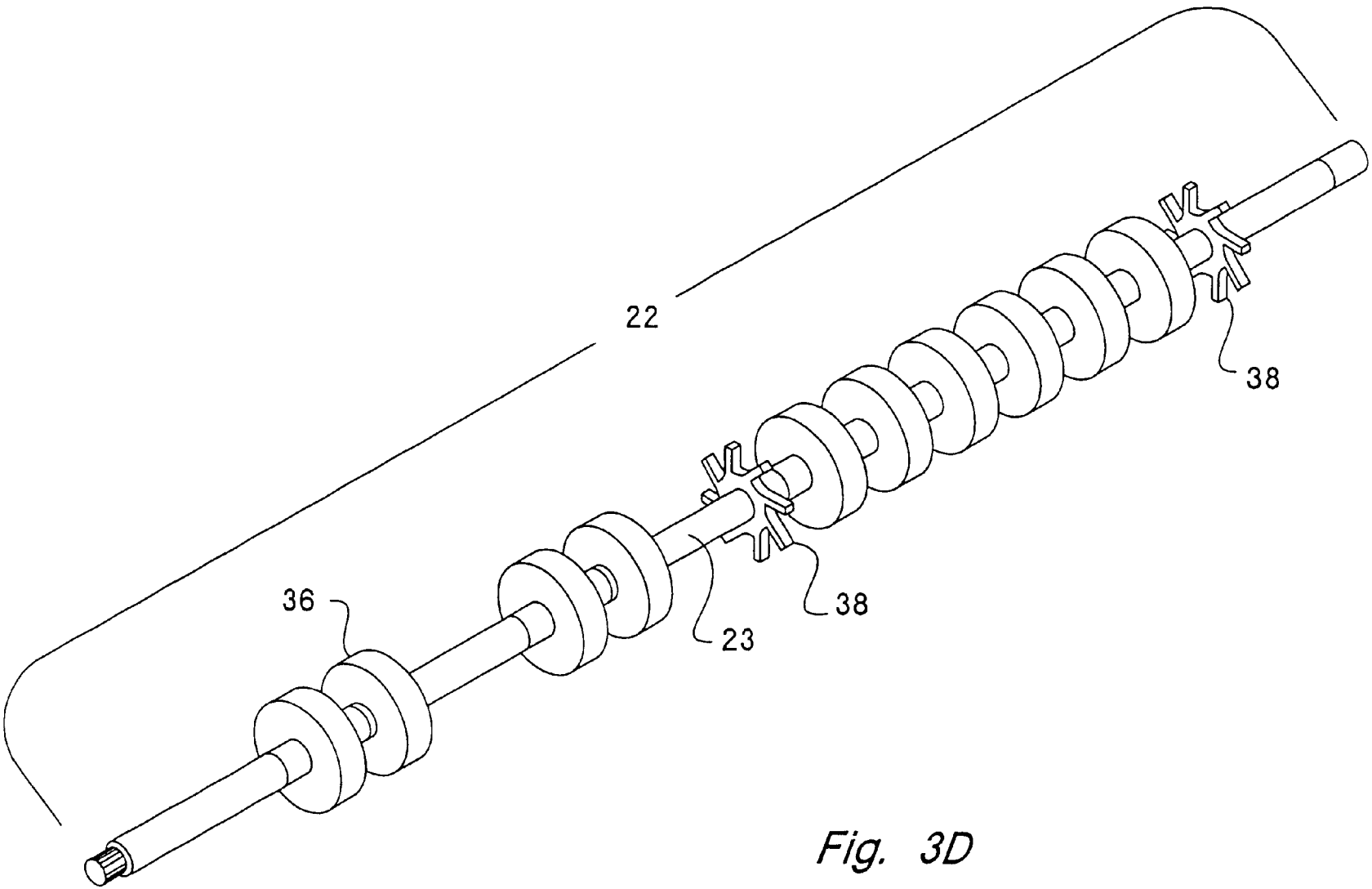
FIG. 3D shows the fourth preferred embodiment of the output roller.

In a fourth preferred mode as shown in FIG. 3D, the protrusions 38 are flexible. Preferably, they are made of flexible materials, such as molded rubber. The protrusions 38 are assembled onto the output shaft 23 of the output roller 22 and are designed to be spikes. The spikes extend slightly, e.g. 1.5 mm, radially above the circular-shaped section 36. Thus, the rear edge of the media sheet can also be caught by two adjacent spikes. The spikes are designed to be soft enough so as to prevent the edge of the media sheet from being damaged when it hits the spikes. Nevertheless, the spikes are designed to be biased in the direction for the media sheet to be pushed forward. In this way the spikes are rigid enough to push the media sheet forward onto the output stack 34.

INDUSTRIAL APPLICABILITY

Figure 5:
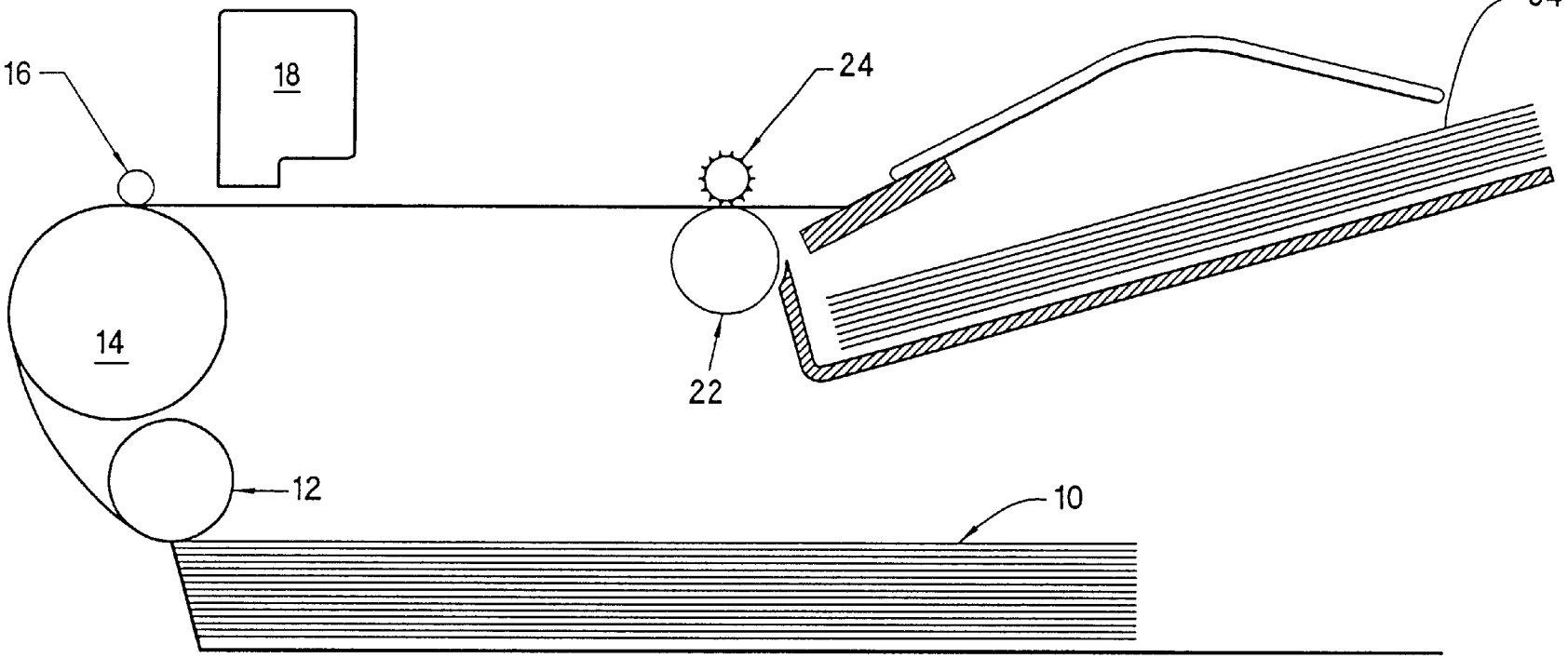
FIG. 5 shows the application of the output roller in an improved output handling system.

The invented apparatus provides a convenient and effective way of ensuring the smooth movement of the media sheet as it exits the media path. The inventive output roller enhances the momentum the media sheet has gained during ejection and thus significantly increases the throughput by reducing tail gating distance between the media sheets without adversely affecting output stack performance. Besides, owing to the enhanced momentum the media sheet has gained, the printed media can be held for a longer distance for drying before it is placed into the output tray. As shown in FIG. 5, a supporting ramp 42 can be used to hold the media sheet 30 for a longer distance. Thus the media sheet 30 gets longer time for drying so as to avoid smearing of the previously printed media sheets.

What is claimed is:

1. An output roller for propelling a media sheet, comprising: a plurality of protrusions selectively positioned on the roller, wherein at least one of the protrusions is positioned to catch the rear edge of the media sheet and to propel the media sheet forward, and wherein the protrusions form a first tooth-shaped section.

2. The output roller of claim 1, further comprising at least one longitudinal section without said protrusions for pulling the media sheet.

3. The output roller of claim 2, wherein the maximum distance between the end edges of the protrusions and the axis of the roller is longer than the radius of the section having no protrusions.

4. The output roller of claim 3, wherein the difference between said radius and said maximum distance is about 0.37–0.50 millimeter.

5. The output roller of claim 1, further comprising an output shaft, the protrusions being positioned on the output shaft.

6. The output roller of claim 1, wherein the protrusions radiate from the axis of the roller.

7. The output roller of claim 1, further comprising at least one non-protrusion section for pulling the media sheet.

8. The output roller of claim 7, wherein the diameter of the first tooth-shaped section is larger than the diameter of the non-protrusion section.

9. The output roller of claim 1, wherein the number of the protrusions of the first tooth-shaped section is about 20–24.

10. The output roller of claim 1, wherein the protrusions form a second tooth-shaped section.

11. The output roller of claim 10, further comprising at least one non-protrusion section for pulling the media sheet.

12. The output roller of claim 11, wherein the diameter of one of the two tooth-shaped sections is larger than the diameter of the non-protrusion section.

13. The output roller of claim 10, wherein the first tooth-shaped section and the second tooth-shaped section are similar in size.

14. The output roller of claim 10, wherein the first tooth-shaped section and the second tooth-shaped section are similar in shape.

15. The output roller of claim 10, wherein the two tooth-shaped sections are located at the middle and the end parts of the roller respectively.

16. The output roller of claim 1, wherein the protrusions are flexible.

17. The output roller of claim 16, wherein the protrusions are made of flexible material.

18. The output roller of claim 17, wherein the protrusions are made of molded rubber.

19. The output roller of claim 16, further comprising at least one longitudinal section without said protrusions for pulling the media sheet.

20. The output roller of claim 19, wherein the protrusions extend radially above said section having no protrusions.

21. The output roller of claim 16, wherein the protrusions are biased.

22. The output roller of claim 16, wherein the protrusion are designed to be spikes.

23. The output roller of claim 16, further comprising an output shaft, the protrusions being assembled onto the output shaft.

* * * * *